US005131360A

United States Patent [19]

Muschalik

[11] Patent Number: 5,131,360

[45] Date of Patent: Jul. 21, 1992

[54] LOAD ADJUSTMENT DEVICE

[75] Inventor: Gerald Muschalik, Eschborn, Fed. Rep. of Germany

[73] Assignee: VDO Adolf Schindling AG, Frankfurt am Main, Fed. Rep. of Germany

[21] Appl. No.: 698,699

[22] Filed: May 10, 1991

[30] Foreign Application Priority Data

May 12, 1990 [DE] Fed. Rep. of Germany ..... 4015353

[51] Int. Cl.[5] ..... F02D 9/02; F02D 11/04

[52] U.S. Cl. ..... 123/339; 123/361; 123/399

[58] Field of Search ..... 123/361, 399, 339

[56] References Cited

U.S. PATENT DOCUMENTS 4,953,529 9/1990 Pfalzgraf et al. ..... 123/361 X
5,014,666 5/1991 Westenberger ..... 123/399 X
5,036,813 8/1991 Pfalzgraf et al. ..... 123/339

FOREIGN PATENT DOCUMENTS 0300153 1/1989 European Pat. Off. .
0389649 10/1990 European Pat. Off. .
0412237 2/1991 European Pat. Off. .

*Primary Examiner*—Tony M. Argenbright
*Attorney, Agent, or Firm*—Martin A. Farber

[57] ABSTRACT

A load adjustment device has a throttle valve (9) which determines the output of an internal combustion engine and is connected, fixed for rotation, with a throttle-valve shaft (36) arranged in a throttle-valve housing. A control element cooperates with a driver 4 coupled to an accelerator pedal (1), and acts on the throttle-valve shaft (36). In addition to the one driver (45), two further drivers (49, 51) forming a free-travel hook (47) are provided, having at least two stops between which a driver (52) of the throttle-valve shaft (36) is adjustably received. By the use of the first driver (45) between the electric motor (14) and the throttle-valve shaft (36), the coupling provided on the driven shaft (39) of the electric motor (14) can be dispensed with in simple manner. By the advantageous development of the free-travel hook (47) in combination with the two drivers (49, 51) and the springs (46, 70), the throttle-valve shaft (36) is acted on by pressure from both sides so that, upon upward control and downward control, no sudden change in torque occurs upon the displacement of the throttle valve (9).

8 Claims, 2 Drawing Sheets

LOAD ADJUSTMENT DEVICE

FIELD AND BACKGROUND OF THE INVENTION

A load adjustment device has a throttle valve (9) which determines the output of an internal combustion engine and is attached, fixed for rotation, to a throttle-valve shaft (36) arranged in the throttle-valve housing. The load adjustment device includes a setting element which cooperates with a driver (4) coupled to an accelerator pedal (1), the pedal acting on the throttle-valve shaft. The setting element is adapted for control by an electric motor (14) which cooperates with an electronic regulating device (17), the motor being adapted for connection to the throttle-valve shaft (36) by a first driver (45) which acts in a single direction.

In load adjustment devices which cooperate with carburetors or injection pumps, optimal control of the internal combustion engine over the entire range of loads is necessary. For this purpose, complicated construction or complicated control is necessary. Thus, carburetors, for instance, in addition to the actual means for forming the mixture have additional devices such as leaning, starting, idling, accelerating and economizing devices, etc. These means complicate the construction of the carburetor and result in a high expense for structural parts, in that additional injection nozzles, pumps, special developments of the nozzle needles, and separate air feeds are necessary, entirely aside from the extensive control requirements connected therewith.

It is particularly important in load adjustment devices to control the state of the idling load, at which only minimum power is given off by the internal combustion engines which however, under certain circumstances and particularly in motor vehicles, must cover load-consuming devices which require extensive power, such as fans, rear-window heating, air conditioning, etc. In order to take these possible power requirements into account, control of the load adjustment device between a minimum idle position and a maximum idle position is necessary. In the event of failure of the control, an emergency idle position of the setting member or control member must be assured.

Differing from the problem described above, load adjustment devices of the type indicated are used, in general, in cases in which the accelerator pedal and the setting member are electronically connected to each other. The accelerator pedal is coupled to the driver and the latter is coupled to the control element. Furthermore, a desiredvalue detection element which is associated with the driver and an actual-value detection element which cooperates with said desired-value detection element and acts on an electric setting drive are provided, the electric setting drive being adapted to be controlled by an electronic control means as a function of the values detected.

The electric connection of accelerator pedal and setting member with the electronic control means interposed between them makes it possible: (1) to set desired-value positions pre-determined by the accelerator pedal and the driver connected to it with reference to the actual values indicated by the position of the control element and of the setting member, and (2) to check them for the existence or absence of plausibility conditions. Thereby, if certain plausibility conditions are present or absent, the possibility exists of acting, via the electronic control means, by control of the electric setting drive on the setting member in order to correct it. The electric setting drive may be developed, for instance, as throttle valve or injection pump.

Thus, for instance, action by the electronic control means can be provided in order to avoid wheel slippage when starting as a result of the establishing of excessive power by way of the gas pedal. Other automatic actions on the load adjustment device are, for instance, conceivable in connection with the automatic shifting processes of a transmission, a speed-limiting control or the above-mentioned idling control of the internal combustion engine.

SUMMARY OF THE INVENTION

In contradistinction to the foregoing, it is an object of the invention to create a load adjustment device of the aforementioned type which, while of structurally simple development and with the omission of expensive parts, assures a reliable and precise control of the internal combustion engine over the entire idling range and a downward control upon response of the anti-slip control means.

According to the invention, in addition to the one driver (45), there are provided two additional drivers (49, 51) which are spaced apart from each other and form a free-travel hook (47) having at least two stops. Between these stops a driver (lever, for instance 52) of the throttle-valve shaft (36) is contained. By the use of the first driver, located between an electric motor and throttle-valve shaft, a coupling provided on the output shaft of the motor can be dispensed with readily.

If a case of anti-slip control occurs in the full-load control range, then the first driver assures that control can be effected downward from the full-load control range into the idle control range. For this purpose, it is advantageous that the free-travel hook (47) for the reception of a lever (52) of the throttle-valve shaft (36) be displaceable by means of a first spring (46) in the maximum idling direction, and by means of a second spring (22) in the minimum idling direction. In this way, assurance is had that the throttlevalve shaft is constantly acted on by pressure means so that, upon both upward control and downward control, no sudden change in torque occurs on the throttle-valve shaft upon the displacement of the throttle valve. In this way, the throttle valve can be controlled very precisely and set to the position desired in each case.

Further according to the invention, the lever (52) of the throttle valve shaft (36), which lever is movable between the two drivers (49, 51), can be displaced by means of a third spring (70) in the direction towards the third driver (51) of the free-travel hook (47) and be brought to rest against the latter. The object of the third spring is to act on the lever of the throttle valve continuously in upwardcontrol direction, i.e. in the direction towards the maximum idling position. The electric motor acts by means of the first driver against the setting force of the third spring and in this way keeps the driver of the throttle valve operatively connected with the third spring. If, for instance, the electric motor is controlled in upward control direction by means of an electric control device, then the third spring brings the throttle-valve shaft to the maximum idling position.

According to a feature of the invention, the third spring (70) can displace the lever (52) into the maximum idling position, and is developed as a compression spring which acts at its one end against the second driver (49) and at its other end against the lever (52) of the throttle valve (36).

The free-travel hook (47) advantageously can be brought by the first spring (46) to rest against a stop (63) which is provided on the driver (4). The device (4) is displaceable via the accelerator pedal (!). Accordingly the throttle valve, when the idle control range is left, is displaced in full-load direction via the accelerator pedal and the second driver, the accelerator pedal operating against the action of the return spring. If a case of anti-slip control occurs, then the free-travel hook is moved away from the stop of the driver connected with the accelerator pedal against the action of the first spring, or anti-slip control spring, and the throttle valve is displaced into the desired position. The displacement of the free-travel hook takes place in the case of anti-slip control via the electric motor. In this case, the driver has no influence on the position of the throttle valve.

According to a preferred embodiment of the invention, it is finally provided that the driver (45) which is functionally connected with the electric motor 14 can be acted on in idling direction (LL) by means of the second spring (22) and brought against a fourth spring or emergency-operation spring (20). Upon failure of a control device (17) for the controlling of the electric motor (14), the emergency operation spring displaces the throttle valve (9) into an $idle_{emerg}$ position. In this way, the throttle-valve shaft is advantageously acted on by force in both directions of rotation so that no sudden changes in torque occur upon a change in load. Also, the movable parts of the setting member are assured very gentle treatment, and the life of the setting member is thereby increased.

As a result of the invention, it is possible in simple manner for the accelerator pedal (1) to be connected operatively by the driver (4) and the first spring (46) to the free-travel hook (47) having the two drivers (49, 51), arranged spaced apart from each other. Between the two drivers (49, 51), the lever (52) which is arranged on the throttle-valve shaft (36) can be continuously acted on by pressure means between a lower idle position ($LL_{min}$) and an upper idle position ($LL_{max}$).

It is furthermore advantageous that the first spring (46), which acts between the free-travel hook (47) and the driver (4) which is functionally connected with the accelerator pedal (!), can be pre-stressed via the electric motor (14) or the accelerator pedal (1). By the use of the spring, the stop which is connected with the throttle-valve shaft can be moved in simple manner away from the lever of the throttle-valve shaft when the full-load control range is to be left. Furthermore, it is possible in advantageous manner, in the event of anti-slip control, to move the free-travel hook immediately away from the stop so that the driver then can no longer affect the position of the throttle-valve shaft. In the event of anti-slip control, the electric motor is controlled via the control device until a normal situation is again re-established.

BRIEF DESCRIPTION OF THE DRAWINGS

With the above and other objects and advantages in view, the present invention will become more clearly understood in connection with a detailed description of the preferred embodiment when considered with the accompanying drawings of which.

DETAILED DESCRIPTION OF THE PREFERRED EMBODIMENT

Figure 1:
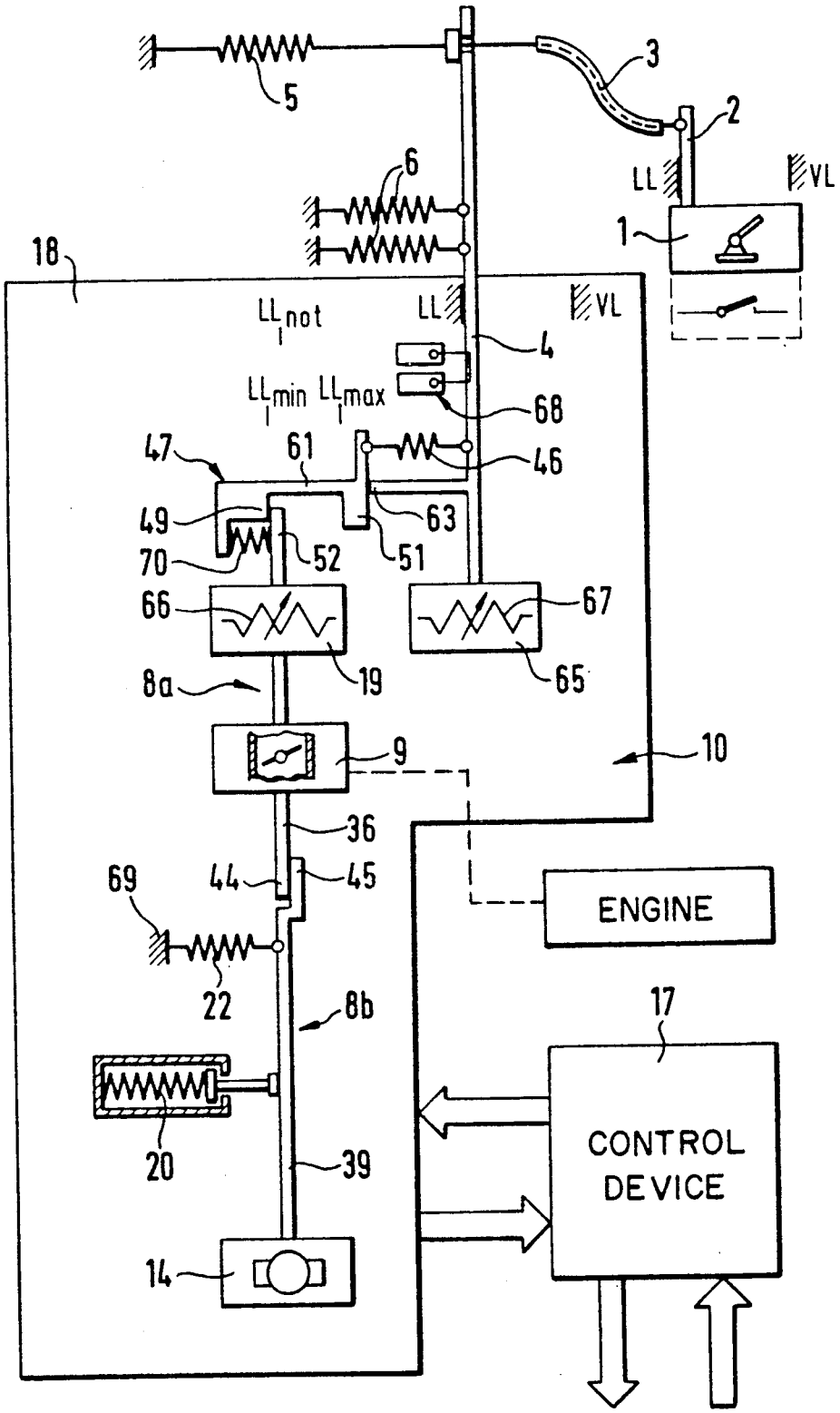
FIG. 1 is a block diagram serving to explain the basic function of the load adjustment device of the invention in conjunction with the free-travel hook of the invention and FIG. 2 is a perspective view.

The parts shown within the frame 18 in FIG. 1 form a setting member or a load adjustment device 10 which are combined in a structural unit. The load adjustment device 10 includes a setting motor or electric motor 14 which is operatively connected via a transmission, not shown in the drawing, to a driven shaft 39 which is operatively connected via a first driver 45 to a throttle-valve shaft 36 and then to a throttle valve 9. Connection of the throttle valve to an engine is indicated by a dashed line. Via the driver 45, the setting forces of the electric motor 14 are transmitted to the throttle valve 9 in downward control direction, in which way displacement into the desired position $LL_{min}$ is brought about.

As can be noted from FIG. 1, the load adjustment device 10 can be displaced via an accelerator pedal 1, in which connection, by actuation of the accelerator pedal 1, a lever 2 is shifted between an idle stop LL and a full-load stop VL and urged in idle direction LL via a return spring 5. The accelerator pedal 1 is connected by a gas cable 3 (such as Bowden cable) to a driver 4 so that upon actuation of the accelerator pedal 1 the driver 4 is displaced in the direction of the full-load stop VL.

There is connected to the driver 4 at least one return spring 6 which urges it in the idling direction LL. As long as the gas cable 3 is not acted on, the driver 4 rests against the idle stop LL associated with it.

The driver 4 cooperates, via a first spring 46, with a free-travel hook 47 which, in accordance with the invention, consists of a displaceably mounted rod 61 with, arranged thereon, drivers 49, 51 which form a recess within which a lever 52 of a first control-element part 8*a* is received.

The free-travel hook 47 is pulled by the spring 46 against a stop 63 provided on the driver 4, so that the free-travel hook 47 can, if necessary, move away from the latter.

The first control-element part 8*a* consists of the lever 52 and of a throttle-valve shaft 36 which receives it. The load adjustment device !0 of the invention has, in addition to the first control-element part 8*a*, a second control element part 8*b* which is developed as driven shaft 39 of the electric motor 14.

The driven shaft 39 has, at its end, a first driver 45 which can be brought to rest against a driver or lever 44 arranged on the throttle-valve shaft 36 so that the first driver 45 and the driver 44 represent a one-way coupling which permits displacement of the throttle-valve shaft 36 only in the direction of the idle position $LL_{min}$. To the driven shaft 39 there is connected a spring 22 the other end of which is connected to a stationary point 69 in the load adjustment device 10 and urges the driven shaft 39 and thus also the throttle-valve shaft 36 together with the throttle valve 9 in the direction of minimum idle position ($LL_{min}$). In this position $LL_{min}$, the lever 52 of the first control-element part 8*a* also rests against the second driver 49 so that over the entire idle control range $LL_{min}$ to $LL_{max}$ the free-travel hook 47 is urged in the idle direction $LL_{min}$. If, for instance, the accelerator pedal 1 is acted on, then, via the second driver 49, the throttle valve shaft 36 is actuated in upward control direction outside of the idle control range, i.e. in partial load or full-load operation. The spring 46 in partial-load or full-load operation pulls the free-travel hook 47 against the stop 63 so that the two control elements are displaced as a unit.

In order to couple the two control-element parts 8*a* and 8*b* mechanically with each other in downward-control direction, the driver 45, as already explained, rests against the driver 44, the spring 22 moving the throttle-valve shaft 36 into the $idle_{min}$ position so that an emergency operation spring 20 which acts against the driven shaft 39 is compressed. Assuming that the throttle valve 9 is displaced between the operating positions $LL_{min}$ and $LL_{max}$ within an angular region of 8° by the electric motor 14, then the driven shaft 39 of the electric motor 14 is turned by about 560° by a transmission, not shown in the drawing. The emergency operation spring 20 provides assurance that, in the event of a defect in an electronic control device 17 or the electric motor 14, the moments of resistance of the electric motor 14 or of the transmission parts and/or the vacuum forces are overcome and the throttle valve 9 returns into the idle emergency position ($LL_{emerge}$).

Upon the transmission of the rotation of the driven shaft 39 of the electric motor 14, the actual-value detection device 19 is advantageously arranged in the region of the swingable free-travel hook 47, while the desired-value detection device 65 is provided in the region of the driver 4.

If a case of anti-slip control occurs, then the internal combustion engine is regulated downward by means of the electric motor 14. In this way, reliability of operation is increased since there is assurance that in the event of anti-slip control, no upward control of the internal combustion engine is possible since the driver 45 cannot turn the throttle-valve shaft 36 in the open direction.

In FIG. 1, the electronic control device 17 which contains preparation, logic and control circuits is diagrammatically indicated. In its digital part, the control device 17 stores values for the adjustment of the vehicle and processes the digital or digitized values of different input variables which then control the desired position of the throttle valve 9 via an analog part. With the electronic control device 17 there cooperates the one actual-value detection device 19 belonging to the control-element parts 8*a*, 8*b* as well as a desired-value detection device 65 which is associated with the driver 4 and determines the instantaneous position of the driver 4.

The potentiometer 66 is associated with the first actual-value detection device 19 and a second potentiometer 67 is associated with the desired-value detection device 65.

The control device 17 has the task of detecting all signals entered, for instance speed, by means of the potentiometers 66, 67 and of comparing them with one another. If the speed of the vehicle, for instance, differs from the desired value which has been set, then the setting member is controlled until the predetermined speed is reached.

The electronic control device 17, furthermore, via an idle contact 68 which is activated by the driver 4, detects signals when said contact comes against the idle stop LL associated with it so that the electric motor is controlled via the control device in the idle control range.

The electronic control device 17, in combination with the actual-value detection device 19 and the external reference variables, serves the purpose of establishing a safety logic with regard to the control of the first and second control-element parts 8*a*, 8*b*. As soon as the electronic control device 17 or the electric motor 14 no longer operates properly, the throttle valve 9 is moved into the emergency position $LL_{emerg}$ by the idle emergency operation spring 20, which is stressed in the direction towards the maximum idle position.

By the load adjustment device of the invention, upward ($LL_{max}$) and downward ($LL_{min}$) control can be effected over the entire idle range by means of a single setting member. Furthermore, it is possible, by means of the electric motor 14 and the first driver 45, to assure outside the idle control range, in case of an anti-slip control, a downward adjustment of the internal combustion engine, the driver not being able in such control case to change the position of the throttle valve by means of the accelerator pedal.

It is particularly advantageous that the free-travel hook 47 be adjustable, in order to receive the lever 52 of the throttle-valve shaft 39, by means of the first spring 46 in the $idle_{max}$ direction and by means of a second spring 22 in the $idle_{min}$ direction, and that the third spring 70 moves the lever 52 in the upward control direction. In this way, assurance is had that the throttle-valve shaft 36 is continuously acted on by pressure means. In this way, the throttle valve 9 can be controlled very precisely and set to the position desired in each case.

According to FIG. 1, the displacement of the throttle valve 9 is normally effected purely mechanically by the gas pedal 1, the lever 2, the gas cable 3, the driver 4, the rod 61, the lever 52 and the throttle-valve shaft 36. In this connection, the drive shaft 39 of the electric motor 14 is also driven via the driver 44 and the driver 45. For an understanding of FIG. 1, it must be realized that all movements are shown as purely transverse displacements, although in actual practice, rotary movements are generally concerned.

If the lever 2 is moved by the gas pedal 1 from the idle position LL shown in FIG. 1 in direction towards the full-load position VL, then all the above-indicated parts follow along in this movement (to the right in the drawing, functionally in the direction of the opening of the throttle valve 9). Upon this movement, the rod 61 rests firmly, as a result of the action of the spring 46, against a stop 63 (number indicated but not shown) of the driver 4. Upon movement of the lever 2 from left to right, all the initially mentioned parts can be considered mechanically firmly attached to each other. This applies also with regard to movement of the lever 2 from the right to left when the gas pedal 1 is released and the springs 5, 6 and 22 move all parts in the LL direction. Upon these "normal" processes of load adjustment, the electric motor 14 merely travels along, without participating in the displacement process.

The electric motor 14 enters into operation only when, on basis of signals, the electronic control device 17 requires a change in the position of the throttle-valve in direction LL. The rod 61 is then moved away from the stop 63 against the force of the spring 46; in other words, disconnection takes place between driver 4 and rod 61 in the direction of the closing of the throttle valve. In this way, a so-called anti-slip control can be obtained. From the determination that the drive wheels of the motor vehicle are turning, the electronic control device 17 "recognizes" that the motor engine established by the gas pedal 1 is too great for the existing condition of the road. It then intervenes (without the driver being able to prevent this) into the driver/car control circuit, in all cases in the direction of reducing the engine output.

Since one cannot permit the electric motor 14, in case of a disturbance, to open the throttle valve further than determined by the gas pedal, a coupling acting in one direction is provided at 44/45. The drivers 45 and 44 cooperate only for the closing of the throttle valve. In the opposite direction, 45 lifts off from 44 against the force of the spring 22, without the throttle-valve shaft 36 being moved.

All other functions of the load adjustment device shown in FIG. 1 refer to the so-called idle control, i.e. to the case in which the driver, by completing releasing the gas pedal, does not exert any influence on the behavior of the throttle valve. While in traditional load adjustment devices the idle position of the throttle valve was determined by a simple stop, the electric motor 14 which is provided for the anti-slip control, in combination with the electronic control device 17, permits also an automatic adaptation of the throttle valve and thus of the engine output to the different power requirements, which are entirely possible in the idle position of the gas pedal, of the (generally electric) secondary units and devices provided in the motor vehicle. For this purpose, a control path for the lever 52 is provided in the rod 61 between the drivers 49 and 51 (or better, stops 49 and 51), which control path can be displaced by the spring 70 in the direction $ll_{max}$ and by the electric motor 14 in the direction $LL_{min}$. In this way, the idle power of the engine with the gas pedal completely released can be adapted to the power requirement of those consuming devices which have nothing to do with the continued movement of the vehicle itself.

In the event that the electric motor 14 or the electronic control device 17 fails, the spring 22 must be prevented from closing the throttle valve to $LL_{min}$, since this position lies below an emergency idle operation ($LL_{not}$). The emergency spring 20 is therefore so designed that the spring 22 cannot pull the control element part 8*b* beyond a position $LL_{not}$ to the left in the direction $LL_{min}$. $LL_{min}$ can be reached only with the force of the electric motor 14. Furthermore, this idle-operation device is so designed that, upon actuation of the gas pedal, the throttle valve is immediately displaced in the opening direction, regardless of the instantaneous position of the lever 52 between the positions $LL_{min}$ and $LL_{max}$.

The load adjustment device is supplemented by desired value and actual value detection devices (19, 65), each associated with the driver 4 and the lever 52, said devices having the potentiometers 66 and 67 the signals of which are fed to the electronic control device 17.

Figure 2:
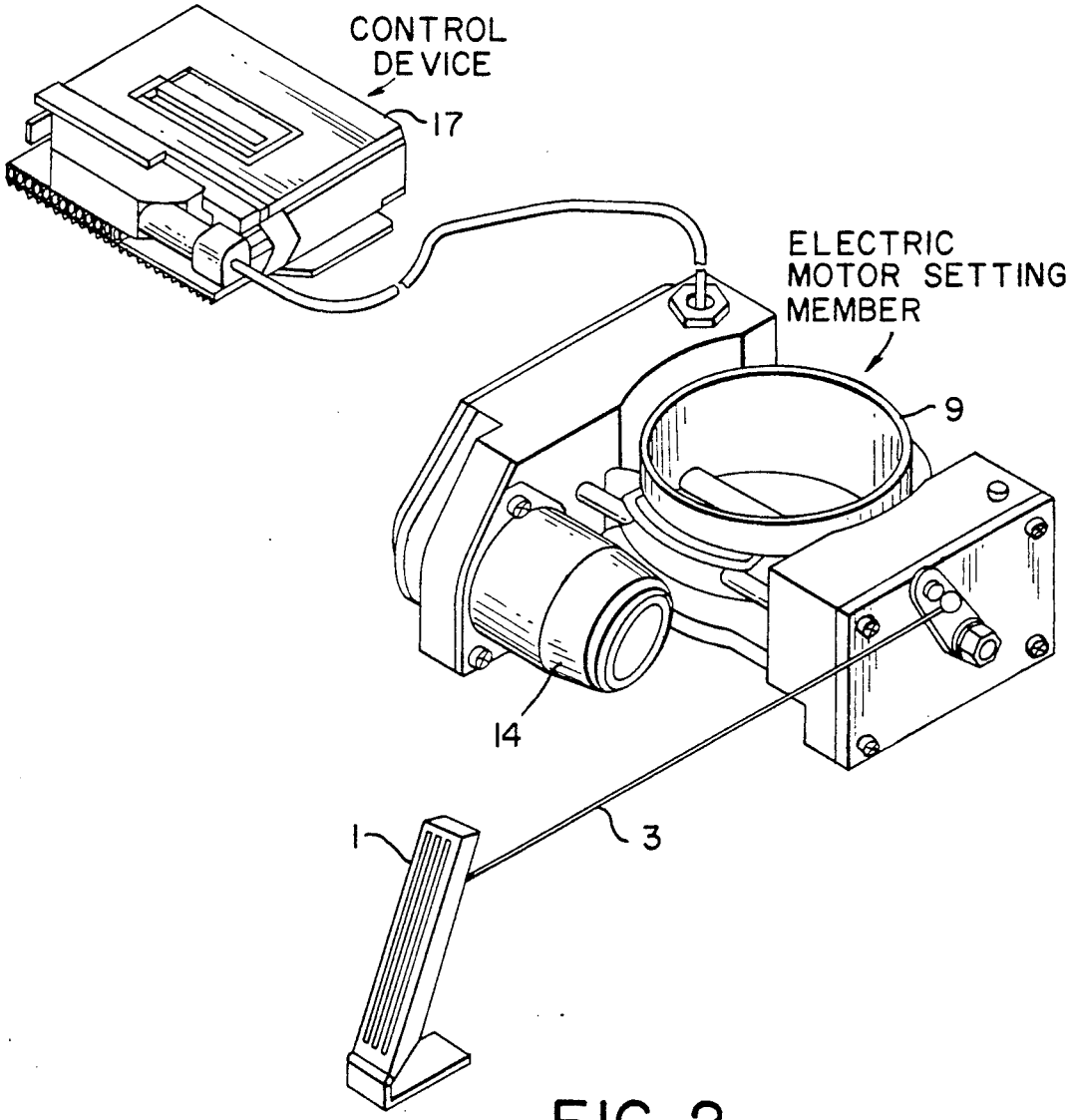

Reference is made to FIG. 2 which is a perspective view of the invention.

In the enclosed perspective view of the invention, all parts in accordance with FIG. 1 of the application which are shown above the throttle valve 9 are arranged in the housing arranged at the right alongside the throttle valve. The parts shown below the throttle valve 9 in FIG. 1 of the application are arranged in the housing to the left alongside the throttle valve in the perspective view.

I claim:

1. A load adjustment device for an internal combustion engine and responsive to an accelerator pedal, comprising;

a throttle valve which determines the output of the internal combustion engine;

a throttle valve shaft having a portion of the shaft configured as a driver lever, a throttle valve housing, a setting element, a first driver, a second driver, a third driver, a fourth driver, an electric motor and an electronic control device; and wherein the throttle valve is attached, fixed for rotation, to the throttle-valve shaft, the shaft being located in the throttle-valve housing;

the setting element cooperates with the fourth driver, the fourth driver being coupled to the accelerator pedal for acting on the throttle-valve shaft;

the setting element is controlled by the electric motor in cooperation with the electronic control device;

the motor is connected to the throttle-valve shaft by the first driver acting in a single direction; and the third and the fourth drivers are spaced apart from each other and form a free-travel hook having at least two stops, the two stops enveloping the driver lever of the throttle-valve shaft.

2. A load adjustment device according to claim 1, further comprising a first spring and second spring; and wherein the free-travel hook for the reception of the lever of the throttle-valve shaft is displaceable by means of the first spring in a maximum idling direction, and by means of the second spring in a minimum idling direction.

3. A load adjustment device according to claim 2, further comprising a third spring; and wherein the driver lever of the throttle valve shaft, which lever is movable between the second and the third drivers is displaceable by means of the third spring in a direction towards the third driver of the free-travel hook to be brought to rest against the third driver.

4. A load adjustment device according to claim 3, wherein the third spring acts to displace the driver lever of the throttle valve shaft into the maximum idling position, the third spring being formed as a compression spring which acts at a first end thereof against the second driver and at its opposite end acts against the driver lever of the throttle valve shaft.

5. A load adjustment device according to claim 2, wherein the fourth driver includes an additional stop; and the free-travel hook is movable by the first spring to rest against the additional stop of the fourth driver, the fourth driver being displaceable by the accelerator pedal.

6. A load adjustment device according to claim 3, further comprising a fourth spring serving for emergency operation; and wherein the first driver which is functionally connected with the electric motor is urged in idling direction by means of the second spring and is brought against the fourth spring; and upon a failure of the control device for a controlling of the electric motor, the fourth spring displaces the throttle valve into an emergency idle position.

7. A load adjustment device according to claim 3, wherein said first and said second and said third springs constitute a pressure means;

the acceleration pedal is connected operatively by the fourth driver and the first spring to the free-travel hook having the second and the third drivers;

the second and the third drivers are spaced apart from each other to receive between them the driver lever of the throttle-valve shaft; and the driver lever of the throttle valve shaft is continuously acted on by the pressure means between a lower idle position and an upper idle position.

8. A load adjustment device according to claim 2, wherein the fourth driver is functionally connected with the accelerator pedal; and the first spring, which acts between the free-travel hook and the fourth driver, is mechanically connected between the electric motor and the accelerator pedal to permit a prestressing of the first spring by the electric motor or the accelerator pedal.

* * * * *